United States Patent [19]

Niihama et al.

[11] 4,260,860

[45] Apr. 7, 1981

[54] DIP ROTARY SWITCH

[75] Inventors: Koichi Niihama, Yokohama; Yoshitada Ishizuka, Tokyo, both of Japan

[73] Assignee: Delphi Company Ltd., Tokyo, Japan

[21] Appl. No.: 942,673

[22] Filed: Sep. 15, 1978

[30] Foreign Application Priority Data

Sep. 29, 1977 [JP] Japan ..... 52-131153[U]

[51] Int. Cl.[3] ..... H01H 19/00

[52] U.S. Cl. ..... 200/6 R; 200/11 B; 200/302

[58] Field of Search ..... 200/302, 303, 6 R, 6 B, 200/6 BA, 6 BB, 6 C, 11 D, 11 DA, 11 G, 11 J, 11 K, 11 TW

[56] References Cited

U.S. PATENT DOCUMENTS 3,903,383 9/1975 Marker ..... 200/11 TW

*Primary Examiner*—J. V. Truhe

*Assistant Examiner*—Morris Ginsburg

*Attorney, Agent, or Firm*—Wenderoth, Lind & Ponack

[57] ABSTRACT

A DIP rotary switch comprising a housing within which rotatable members such as a rotor and a disc are disposed around a pivot protruding from the center of a molded base which horizontally sandwiches a one piece plate terminal manufactured by a punching process. A contact segment of the plate terminal is bent first upward along a step of a hollow disposed at the surface edge of the base and then pressed down to be located along the slot arranged at the surface thereof, while a lead foot is bent downward to a right angle by touching on a step of a hollow arranged at the under surface of the base.

2 Claims, 7 Drawing Figures

DIP ROTARY SWITCH

BACKGROUND AND BRIEF SUMMARY OF THE INVENTION

This invention relates to a rotary switch, more specifically to a rotary switch of the dual-in-line-package type (hereinafter called a DIP rotary switch).

A rotary switch having a "Dual-In-Line-Package" structure is small in size and has been developed for installation on a printed circuit board equipped with electronic appliances and control devices. Because the development of this type of switch has just recently started, only a few types are commercially available at present.

A DIP rotary switch of the prior art comprises a housing having a base made of insulative material through which several plate terminals are mounted in two rows, and further comprises a rotatable disc and a rotor with a rotator which are hermetically sealed within the housing. A projecting portion of the plate terminal positioned through a hole in the base is bent to form a reversed L-shaped contact segment while a downwardly protruding portion serves as a lead foot. Various patterns of conductive material devised to meet the desired purpose of the switch are arranged on the under surface of the disc which is positioned about a pivot in the base, the disc is simultaneously rotatable with the rotor.

With the rotation of the disc and the rotor, the conductive material of the disc may intermittently contact a contact point of the plate terminal arranged on the base, with resultant electrical connection or disconnection of the plate terminals arranged in two rows.

Because the DIP rotary switch of the conventional type is usually installed on a printed circuit board by the lead feet by means of a soldering process, careful attention must be paid to prevent an extra portion of solder or solder flux from flowing through the hole in the base and reaching the contact point thereby making the proper functioning of the switch unobtainable. It is also a common practice to clean the base and terminal assembly by washing with a solvent such as trichlene or Freon, and the same care must be taken to avoid the situation as explained above.

Therefore, to solve afore-mentioned problem, it is necessary to fix the lead foot of each plate terminal to the base hole so firmly and tightly that the flow of the extra material through the hole, as noted above, may be avoided.

Two methods have so far been adapted to avoid this problem. The first method is to tightly bond each lead foot to the base through a hole by applying an adhesive material therebetween, while the second method bonds each lead foot by means of an insert molding process.

However, bonding by means of an adhesive material lacks reliability because it is impossible to perform a satisfactory bonding of the two parts through a hole therebetween. This is also disadvantageous due to poor work efficiency because the plate terminals must be mounted to the base manually on a piece by piece basis.

In the insert molding method, plural plate terminals are simultaneously attached to the base by pouring plastic material into a mold where the plural plate terminals have already been positioned. Therefore, the disadvantage of poor work efficiency may be overcome.

However, a new problem may be created. The base should be arranged to allow the plate terminals to be firmly installed thereto. Therefore, the portion of the plate terminals held or sandwiched by the base must be long and the base must be thick enough to maintain a powerful bond between the plate terminal and the base. However, it is almost impossible to provide a length and thickness beyond a fixed limit due to the structural requirements of the switch, whereby a tight fastening of the plate terminals to the base may not be successfully obtained, with the resultant poor installation of the plate terminal to the printed circuit board.

The position that a plate terminal is usually bent to form a contact point must be selected and arranged with accuracy and efficiency. In this type of conventional switch, it is not an easy job to bend a contact point to be located at the right position with accuracy and efficiency. Usually, the plate terminals have already been manufactured before starting the molding process and they are manually arranged vertically in rows in a mold on a piece by piece basis so as to be ready for the molding process. Therefore, it is naturally difficult to maintain a uniform and firm installation of the plate terminals to the base. In addition, the components required for assembling such a small switch may considerably increase in number with the resultant disadvantages in quality control and work efficiency.

It is, therefore, an object of this invention to provide a DIP rotary switch which has plural plate terminals arranged to be connected and formed integrally as one flat piece, whereby each plate terminal is horizontally and firmly fastened to the base by means of an insert molding process.

Another object of the invention is to provide an improved DIP rotary switch which has a thin base and consists of a small number of components whereby the fastening of the plate terminals to the base may be performed efficiently by the process of molding.

A further object of the invention is to provide a DIP rotary switch whose base has hollows provided with steps at the edges of the surface and at the under surface thereof respectively, and has guide slots positioned at the surface thereof so that the bending of the plate terminals to form contact points and lead feet may be performed with high efficiency and accuracy.

An even further object of this invention is to provide a manufacturing process for the plate terminals and bases of DIP rotary switches.

The above and further objects and novel features of the invention will more fully appear from the following detailed description when read in connection with the accompanying drawings. It is to be expressly understood, however, that the drawings are for the purpose of illustration only and are not intended as a definition of the limits of the invention.

DETAILED DESCRIPTION

The DIP rotary switch of the invention will be described hereinafter, with specific reference to the drawings.

Figure 1:
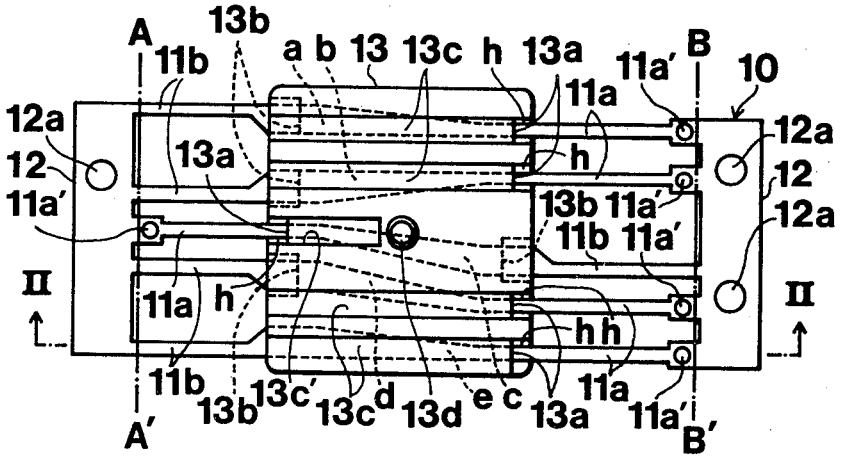
FIG. 1 is a plan view of a preferred embodiment of this invention illustrating plate terminals extending horizontally and sandwiched by a base before any bending or cutting process is started.
Figure 2:
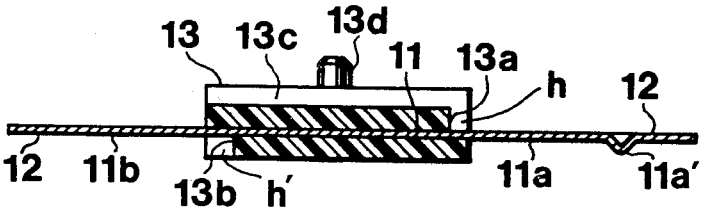
FIG. 2 is a sectional view taken on line II—II of FIG. 1.
Figure 3:
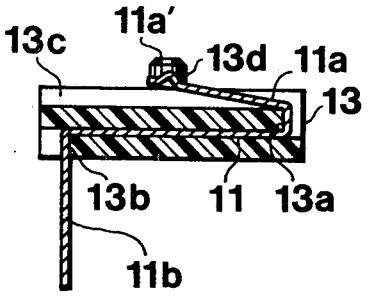
FIG. 3 is a sectional view illustrating a plate terminal being bent to form a contact segment and a lead foot.
Figure 4:
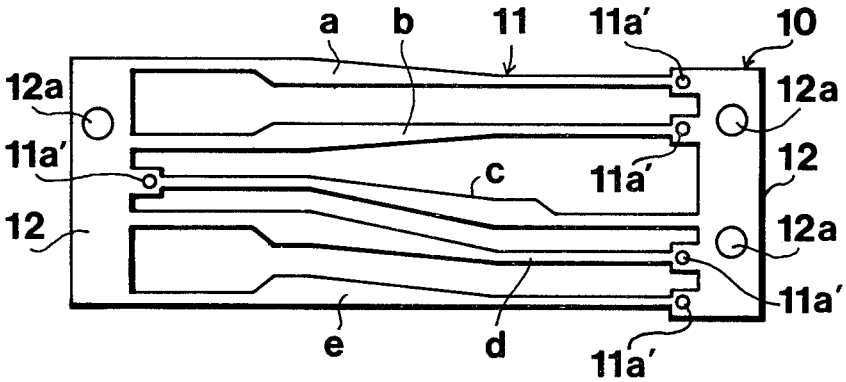
FIG. 4 is a plan view of a plate terminal integrally formed in one rectangular flat piece having intermediate sections of varied shapes.
Figure 5:
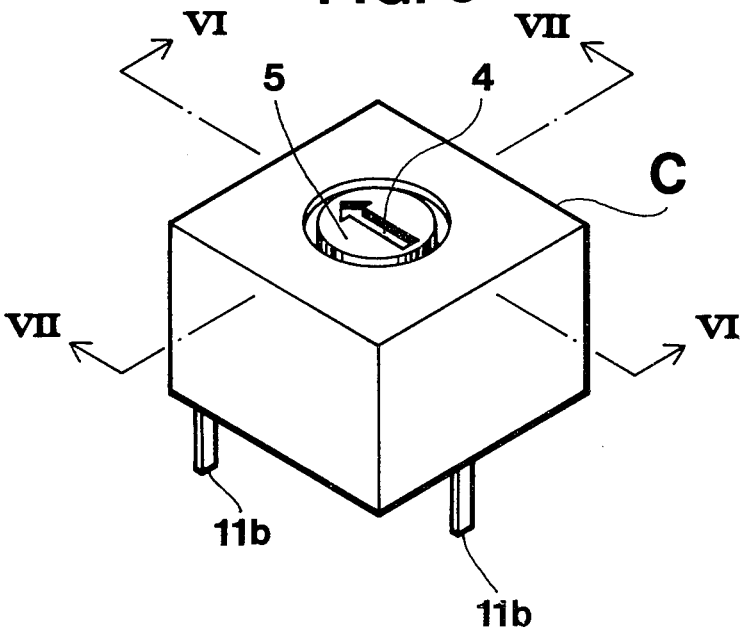
FIG. 5 is a perspective side view of the DIP rotary switch according to this invention.

Referring to FIG. 1 and FIG. 4, numeral 10 indicates a rectangular flat plate comprising plural plate terminals 11 of different shapes. The rectangular flat plate 10 is manufactured from one piece of metal by a punching machine. At both ends of the rectangular flat plate 10, there are end portions 12 provided with three positioning holes 12*a*, two on the right and one on the left, which will be explained hereinafter in detail.

The plate terminals 11, spanning in parallel both end portions 12 of the rectangular flat plate 10, consist of contact segments 11*a* having contact points 11*a'* and lead feet 11*b*. Numeral 13 indicates a base manufactured by a molding process, which sandwiches the horizontal intermediate portions of the terminal plates 11. As is shown in FIG. 1 and FIG. 4, the intermediate portions are formed between contact segments 11*a* and lead feet 11*b* and are of different shapes as indicated by letters a, b, c, d and e.

The molding process is usually performed by the use of two molds, a male mold and a mating female mold.

Figure 6:
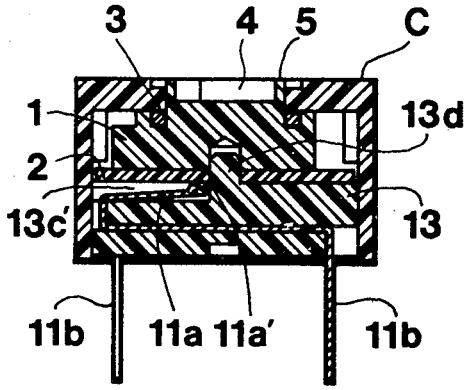
FIG. 6 is a sectional view taken on line VI—VI of FIG. 5.
Figure 7:
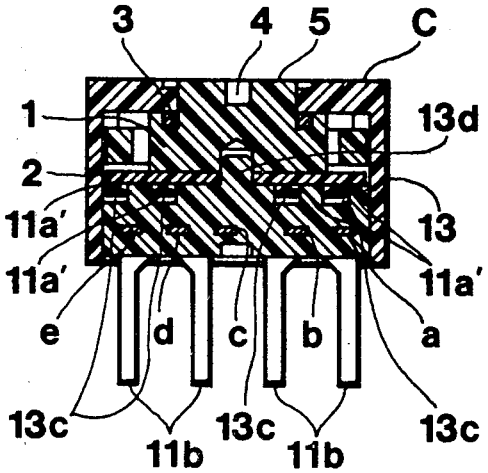
FIG. 7 illustrates a sectional view taken on line VII—VII of FIG. 5.

At both edges of the base 13 where contact segments 11*a* and terminal feet 11*b* are located, there are plural hollows h and h' provided with steps 13*a* and 13*b* respectively, the former being located at the upper surface of the base 13, while the latter, at the under surface thereof. Parallel slots 13*c* are disposed horizontally on the surface of the base 13, extending continuously from the steps 13*a*, starting from right to left as seen facing FIG. 1, thereby connecting the hollows located at both edges of the base. A short slot 13*c'*, starting from left to right, is disposed in the same way, ending close to a pivot provided at the center surface of the base. Numeral 13*d* indicates a pivot protruding from the center surface of the base 13. As shown in FIGS. 6 and 7, the disc and the rotor 1 are held captive in a housing C and are rotatably mounted on the base 13 with the pivot 13*d* as an axis. The rotor 1 and the disc 2 rotate simultaneously clockwise and counter-clockwise about the pivot 13*d* at the center of the base 13 when turned by a screw driver fitted in a slot 4 of the rotator 5 of the rotor 1. The upper outside periphery of the rotor 1 is cut away to provide a space for receiving a resilient O-shaped ring 3 which is pressed into a sealing contact with both the housing and the rotor thereby preventing undesirable material such as dust or grease from passing inwardly toward the upper face of the rotor 1.

The insert molding process is usually performed after both ends of the rectangular flat plate 10 are held firmly by molding devices. In this embodiment, the end portions 12 provided with holes 12*a* are immovably secured by the insertion of matching projections disposed on the mold (not shown) into the holes 12*a* thereof. Thus, the holes 12*a* serve to promote an accurate positioning of the rectangular flat plate during the molding process. After the molding process is finished, the end portions 12 at both ends of the rectangular flat plate 10 are cut off by the use of a cutting apparatus along the lines A—A' and B—B', as is illustrated in FIG. 1. The next step of the process is the finishing of contact segments 11*a* and lead feet 11*b*, which will be described hereinafter.

The contact segment 11*a* forming a part of terminal plate 11, which protrudes horizontally from the base 13, is bent along the step 13*a* first in an upward direction and then pressed downwardly along the slot 13*c* or 13*c'* guided thereby until the contact point 11*a'* is positioned so as to be touching the disc 2 after assembly. The lead foot 11*b*, which protrudes horizontally from the base 13, is bent downwardly touching the step 13*b* and projects downwardly from the base, as is illustrated in FIGS. 6 and 7, thereby completing the installation of the plate terminals 11 to the base 13.

A disc 2 and a rotor 1 are held captive in a housing C while the base 13 is hermetically sealed to the housing. The rotor and the disc rotate simultaneously with pivot 13*d* as an axis, as is shown in FIG. 6 and FIG. 7. The under surface of the disc touches the contact point 11*a'*. With the rotation of the disc and the rotor, the conductive material disposed on the under surface of the disc may intermittently touch a contact point, with resultant electrical connection or disconnection between the plate terminals arranged in two rows.

It is apparent from the foregoing explanations that the positioning holes 12*a* are used to determine the required position of the plate 10 in such operations as the punching of the rectangular flat plate 10, the insert molding of the base 13 and the cutting of the end portions 12 of the rectangular flat plate 10.

As has been clearly understood by the foregoing description, the DIP rotary switch according to this invention provides the following advantages:

(1) The plate terminals are manufactured by a punching machine from one piece of rectangular flat plate and are horizontally sandwiched by the base during the molding process which results in the successful firm and stable fastening of the plate terminals to the base.

(2) The base is thin enough to receive a flat plate terminal horizontally by means of the insert molding process and the plate terminal consists of a substantially reduced number of components thereby reducing the physical size of the resultant switch.

(3) The base has hollows provided with steps at both edges of the upper and under surface thereof and has slots arranged at its surface so that each plate terminal used to form the contact point may be bent efficiently and accurately, guided by the steps and slots of the base. Similarly, the lead foot may be bent along the steps of the base in the same manner.

Only a two piece mold, (a male type and a female type), are required for the molding process. Therefore, an improvement in work efficiency, and an improvement in the molding accuracy may be obtained coupled with a reduction in overall costs.

While the principal embodiment of the present invention is thoroughly described above, those changes and modifications which may occur to individuals skilled in the art without departing from the true spirit and scope of the present invention are also encompassed by the appended claims.

What we claim is:

1. In a DIP rotary switch having a rotatable member including a rotor and attached disc rotatably mounted on a base of a housing, the improvement comprising:

said base of said housing comprising first and second flat oblong shape plates, each plate having top and bottom surfaces with the bottom surface of the first plate immediately adjacent the top surface of said second plate;

first and second pluralities of flat ribbon shaped plate terminals, each terminal having a central portion and two end portions, the central portion of each of said first and second plurality of terminals sandwiched between said top surface of said second plate and said bottom surface of said first plate, said top surface of said second plate and said bottom surface of said first plate being parallel to each other;

the first of said two end portions of each terminal of said first plurality of terminals bent orthogonal to said top and bottom surfaces of said first and second base plates, and the first of said two end portions of each terminal of said second plurality of terminals bent orthogonal to said top and bottom surfaces of said first and second base plates, wherein said first end portions of said terminals of said first and second plurality of terminals form two parallel rows;

said top surface of said first plate having parallel guide slots arranged from edge to edge across said first base plate and having hollows at the edges of said first base plate, wherein the second of said end portions of the terminals of said first and second plurality of terminals are bent to fill said hollows and said guide slots;

each of said second end portions of each of said terminals having a contact segment thereon;

a surface of said disc having conductive patterns thereon, wherein said disc and said first base plate are arranged such that said contact segments make electrical contact with said conductive patterns on said surface of said disc, whereby the electrical interconnection between said terminals of said first and second plurality of terminals may be controlled by rotating said rotor.

2. A DIP rotary switch as in claim 1, wherein said second base plate is provided with hollows on the edges thereof and wherein said first end portions of the terminals of said first and second plurality of terminals are arranged within said hollows.

* * * * *